US006651297B1

(12) United States Patent
Borchardt

(10) Patent No.: US 6,651,297 B1
(45) Date of Patent: Nov. 25, 2003

(54) CLOSURE DEVICE

(75) Inventor: Michael G. Borchardt, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/049,446

(22) PCT Filed: Jun. 6, 2000

(86) PCT No.: PCT/US00/40120

§ 371 (c)(1),
(2), (4) Date: Feb. 5, 2002

(87) PCT Pub. No.: WO01/94212

PCT Pub. Date: Dec. 13, 2001

(51) Int. Cl.[7] ..... B65D 33/25

(52) U.S. Cl. ..... 24/399; 24/400; 24/DIG. 39; 24/30.5 R; 24/30.5 P; 24/DIG. 50; 383/63; 53/139.2

(58) Field of Search ..... 24/399, 585.1, 24/585.11, 585.12, 30.5 R, 30.5 L, 30.5 P, DIG. 38, DIG. 39, DIG. 40, DIG. 50; 383/63–66; 428/99, 100; 53/139.2

(56) References Cited

U.S. PATENT DOCUMENTS 3,806,998 A * 4/1974 Laguerre ..... 24/400
4,561,108 A * 12/1985 Kamp ..... 383/63
4,795,269 A * 1/1989 Scheibner ..... 383/63
4,907,321 A * 3/1990 Williams ..... 24/587
4,917,506 A * 4/1990 Scheibner ..... 383/63
5,056,933 A 10/1991 Kamp
5,366,294 A * 11/1994 Wirth et al. ..... 383/61
5,655,273 A * 8/1997 Tomic et al. ..... 24/587
5,664,299 A 9/1997 Porchia
5,937,615 A 8/1999 Forman
5,965,224 A * 10/1999 Chen et al. ..... 428/35.2
6,217,215 B1 * 4/2001 Tomic ..... 383/63

* cited by examiner

*Primary Examiner*—Robert J. Sandy
(74) *Attorney, Agent, or Firm*—Thomas C. Feix

(57) ABSTRACT

The closure device includes interlocking first and second fastening strips. The first fastening strip includes a closure element extruded onto a flange portion. The closure element and the flange portion are composed of materials having different densities to control the shape of the fastening strips. The purpose of changing the densities of the material is to reduce or eliminate the curve in the fastening strips which occurs during the manufacturing process. By providing a lower density material for the closure element, which has a greater volume, and by providing a higher density material for the flange portion, the flange portion will crystallize at the same rate as the closure element. This difference in densities results in a reduction or elimination in the curvature of the fastening strips.

50 Claims, 7 Drawing Sheets

CLOSURE DEVICE

FIELD OF THE INVENTION

The present invention relates generally to closure devices with interlocking fastening strips and, more particularly, to reducing curvature in interlocking fastening strips. The invention may be employed in traditional fastener areas and is particularly well suited for use in manufacturing closure devices for flexible storage containers, such as plastic bags.

BACKGROUND OF THE INVENTION

The use of closure devices for closing storage containers, including plastic bags, is generally known. The closure device and the associated container are formed from thermoplastic materials. The closure elements are extruded onto a flange portion and in a later step, the flange portion is attached to the sidewalls of the container. This method may cause the flange portion to curve upward along the horizontal axis as shown in FIG. 4.

SUMMARY OF THE INVENTION

The present invention reduces the curvature of the flange portions in the horizontal axis which occurs during the manufacturing process. The closure device includes closure elements extruded onto a flange portion. By altering the densities of the closure elements and the flange portions, the flange portions will have less curvature in the horizontal axis.

The objects, features, and advantages of the present invention will become more readily apparent upon reading the following detailed description of exemplified embodiments and upon reference to the accompanying drawings herein.

DESCRIPTION OF THE EMBODIMENTS

Figure 1:
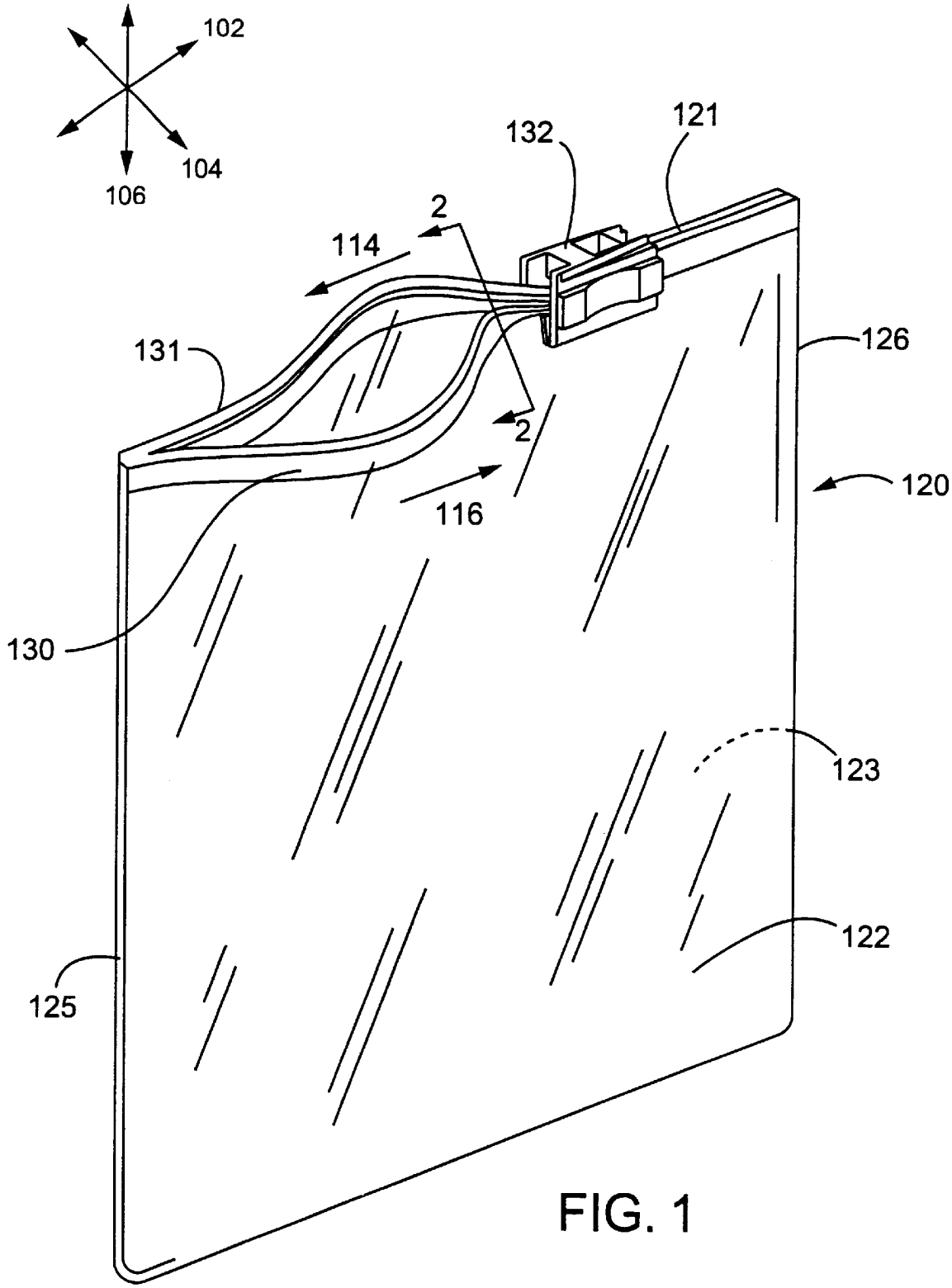
FIG. 1 is a perspective view of a container according to the present invention in the form of a plastic bag.

FIG. 1 illustrates an embodiment of a container in the form of a plastic bag 120 having a sealable closure device 121. The bag 120 includes a first sidewall 122 and a second sidewall 123 joined at seams 125, 126 to define a compartment accessible through the open top end but sealable by means of the closure device 121. The closure device 121 includes first and second fastening strips 130, 131. The closure device 121 may additionally include a slider 132.

The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The fastening strips 130, 131 are adapted to be interlocked between a first end and a second end. The fastening strips 130, 131 are secured together at the first and second ends to form end seals. The slider 132 may be mounted onto the fastening strips 130, 131 so that the slider 132 is restrained from being removed from the fastening strips 130, 131 but free to slide along the X axis 102. The slider 132 engages the fastening strips 130, 131 so that when the slider 132 moves in an occlusion direction 114, the fastening strips 130, 131 interlock and the bag 120 is sealed, and when the slider 132 moves in a deocclusion direction 116, the fastening strips 130, 131 separate and the bag 120 is open.

Figure 2:
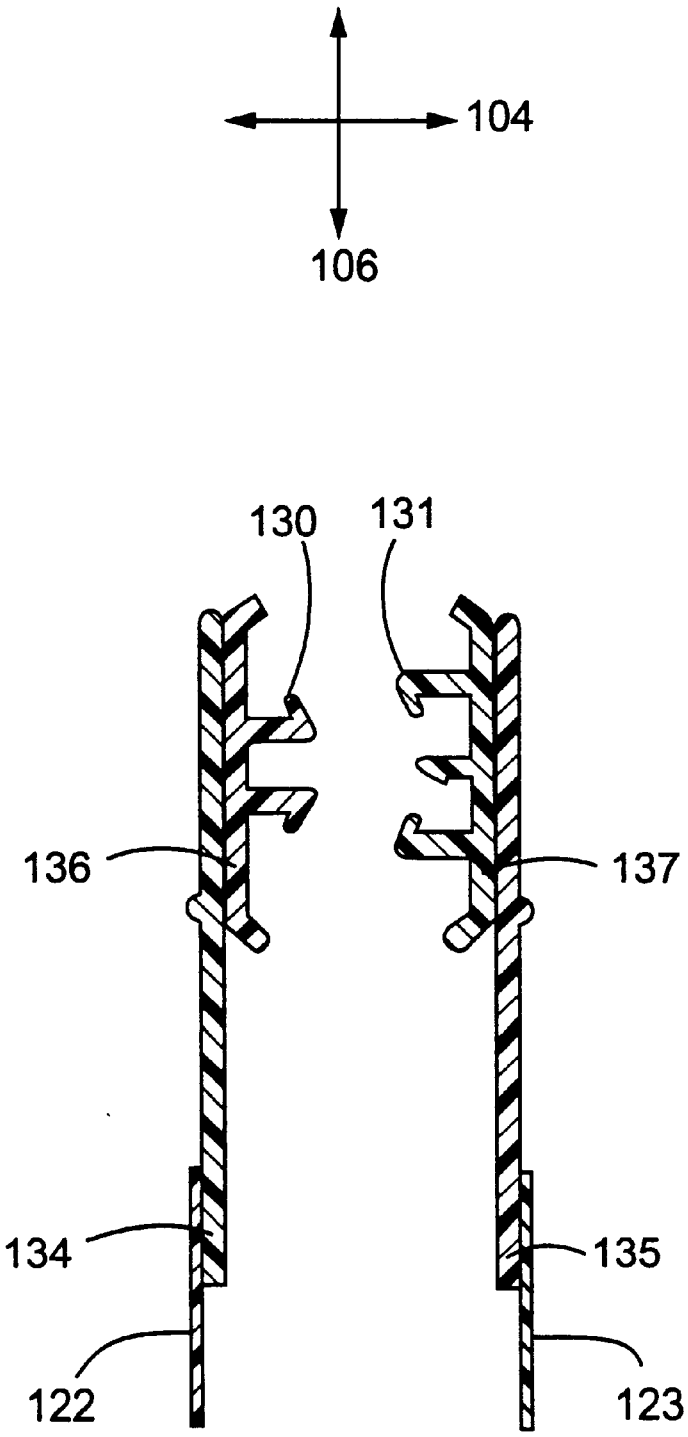
FIG. 2 is a cross-sectional view taken along line 2—2 in FIG. 1.

FIG. 2 illustrates a cross-sectional view of the container in FIG. 1 and depicts first and second fastening strips 130, 131. The first fastening strip 130 includes a closure element 136 extruded onto a flange portion 134. The fastening strip 130 may later be attached to the sidewall 122 of a container. Similarly, the second fastening strip 131 includes a closure element 137 extruded onto a flange portion 135. The fastening strip 131 may later be attached to the sidewall 123 of a container.

Figure 3:
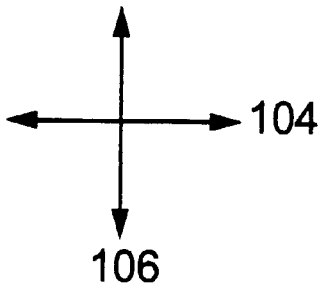
FIG. 3 is a cross-sectional view of another embodiment.
Figure 3:
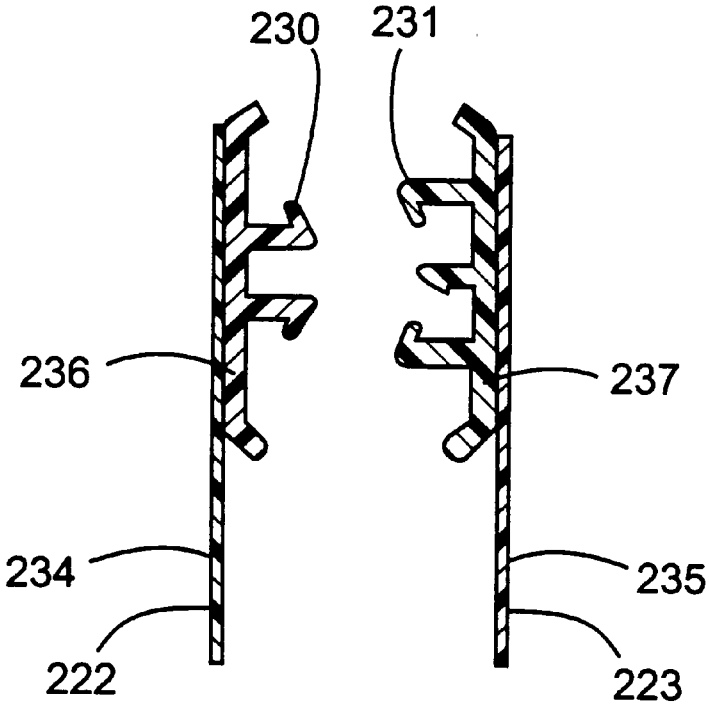

FIG. 3 illustrates a cross-sectional view of another embodiment of fastening strips. The strips 230, 231 include closure elements 236, 237. The closure elements 236, 237 are extruded onto the flange portions 234, 235 of the sidewalls 222, 223 of a bag.

Figure 4:
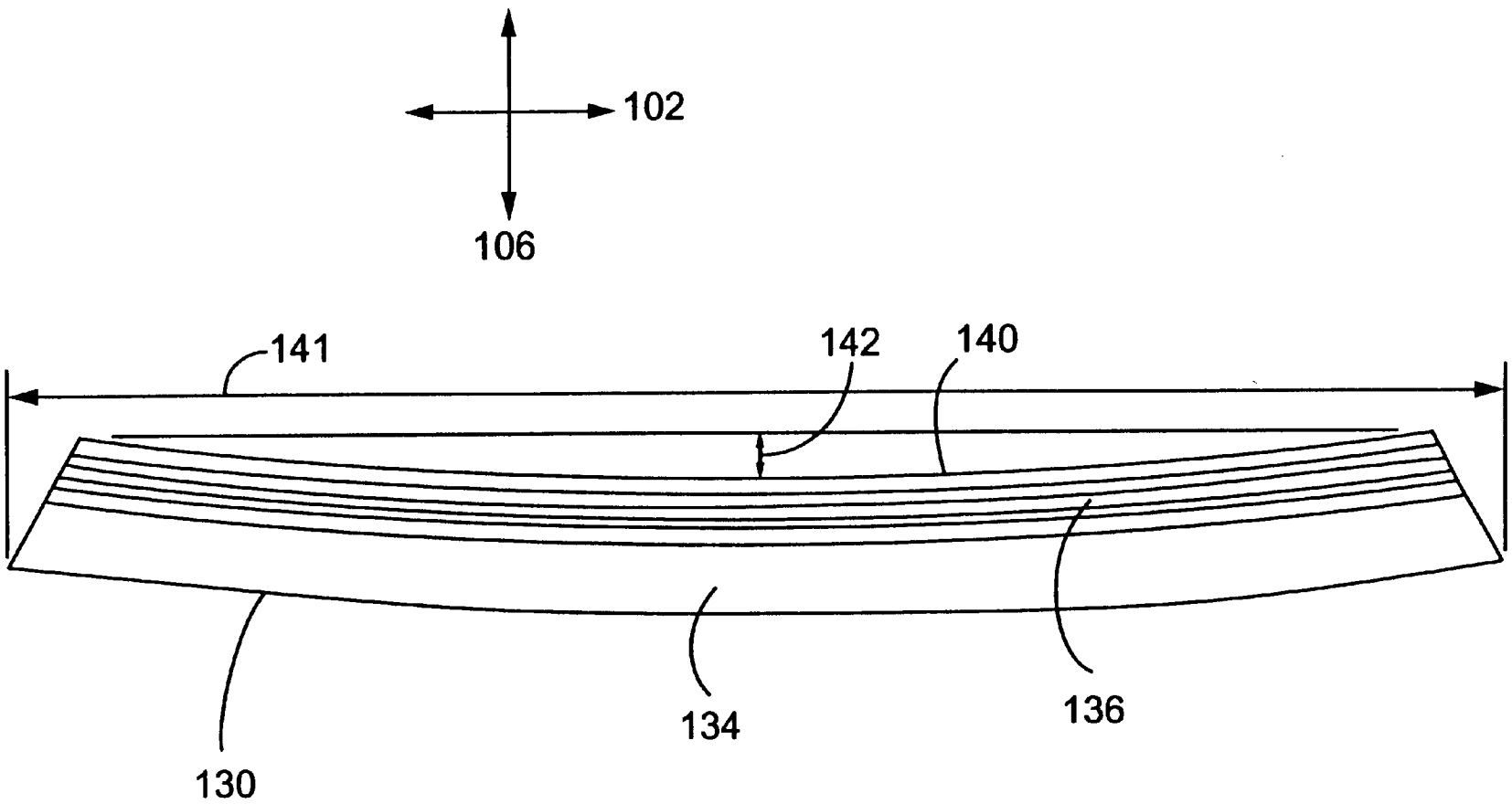
FIG. 4 is a partial front view of a fastening strip which demonstrates curvature in the fastening strip.
Figure 5:
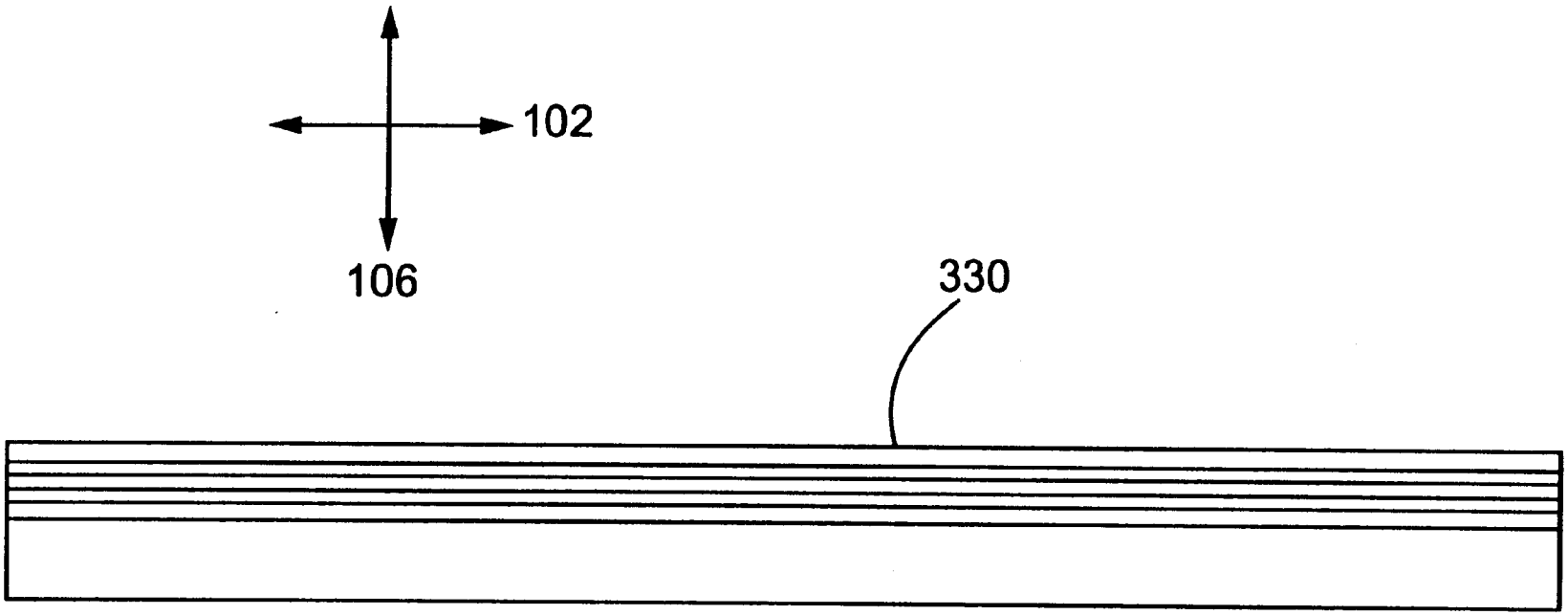
FIG. 5 is a partial front view of the fastening strips which demonstrates no curvature in the fastening strip.

FIG. 4 illustrates a front view of an embodiment of the fastening strip 130 and depicts curvature of the fastening strip 130. The fastening strip 130 generally forms a curve 140 wherein the dimension 141 is the length of the fastening strip and dimension 142 is the amplitude of the curve. Ideally, the dimension 142 should be zero so that the fastening strip 330 has no curve as shown in FIG. 5.

In the past, the closure element 136 and the flange portion 134 were made of the same material and had equal densities. The closure element 136 is greater in volume, and thus greater in mass, in comparison to the flange portion 134 as shown in FIG. 2. During the cooling process, it takes the closure element 136 longer to crystallize, and since the cooling process causes the elements to shrink in all directions, the closure element 136 will shrink more than the flange portion 134. In addition, as shown in FIG. 2, the closure element 136 is positioned near the top of the flange portion 134 (i.e. off-center). The difference in crystallization times between the closure element 136 and the flange portion 134 along with the off-center extrusion of the closure element 136 onto the flange portion 134, causes the fastening strip 130 to have a curve 140 as shown in FIG. 4. A similar result occurs in the mating fastening strip 131.

The densities of the materials may be altered, however, to either increase or decrease the dimension 142. A lower density material may be used in the closure element 136 and a higher density material used in the flange portion 134. If the densities are chosen appropriately, the curve 140 may be reduced or eliminated. More specifically, it is believed that the flange portion 134 being lower in mass, and having a higher surface area than the closure element 136, solidifies before the closure element 136. The flange portion 134 shrinks as it crystallizes and the closure element 136 still being molten, adjusts to the shrinkage. The closure element 136 when it finally crystallizes, shrinks, but the flange portion 134 is now solid and must distort or curl to accommodate the change in dimension imparted by the shrinking closure element. The degree of curl or curve 140 can be changed by adjusting the shrinkage of the closure element 136 as it crystallizes by changing the density of the closure element 136 relative to the flange portion 134. Higher density materials undergo larger changes in dimension as they crystallize compared to lower density materials. Hence it is expected that using a lower density material in the closure element 136 will impart a lower degree of curl or curve 140 to the entire structure because the shrinkage of the closure element 136 has been reduced relative to the flange portion 134.

The following examples demonstrate the effect of changing the density and the resultant change in the height 142 of the curve 140. Example 1 shows the distance 142 when the density of the flange portion 134 and the closure element 136 are the same. Example 2 shows the distance 142 when the density of the flange portion 134 is less than the closure element 136. Examples 3–4 show the distance 142 when the density of the flange portion 134 is greater than the closure element 136.

| Example | Density of Flange Portion (134) g/cc | Density of Closure Element (136) g/cc | Distance (142) (inches) | Distance (141) (inches) |
|---|---|---|---|---|
| 1 | .925 | .925 | .25 | 9.00 |
| 2 | .925 | .932 | .30 | 9.00 |
| 3 | .932 | .925 | .15 | 9.00 |
| 4 | .932 | .921 | .09 | 9.00 |

In Example 1, the flange portion and the closure element are made of tubular low density polyethylene, Product No. NATR 485 from Equistar Chemical, Cincinnati, Ohio, United States of America.

In Example 2, the flange portion was made of tubular low density polyethylene, Product No. NATR 485 from Equistar Chemical, Cincinnati, Ohio, United States of America. The closure element was made of tubular low density polyethylene, Product No. 324.009 from Equistar Chemical, Cincinnati, Ohio, United States of America.

In Example 3, the flange portion was made of tubular low density polyethylene, Product No. NATR 324.009, from Equistar Chemical, Cincinnati, Ohio, United States of America. The closure element was made of tubular low density polyethylene, Product No. NATR 485 from Equistar Chemical, Cincinnati, Ohio, United States of America.

In Example 4, the flange portion was made of tubular low density polyethylene, Product No. NATR 324.009, from Equistar Chemical, Cincinnati, Ohio, United States of America. The closure element was made of tubular low density polyethylene, Product No. E6838, from Eastman Chemical, Kingston, Tenn., United States of America.

When a higher density material is used in the closure element 136 and a lower density material in the flange portion 134, the resulting curve 140 is more pronounced than if identical densities are used. More specifically, the higher density closure element 136 takes even longer to crystallize than if a lower density material is used. In contrast, the flange portion 134, being of a lower density material, crystallizes more quickly than a higher density material. This greater difference in density, between the closure element 136 and the flange portion 134, results in a greater increase in the dimension 142 and the curve 140 than if equal density material is used in both the flange portion 134 and the closure element 136.

It will be readily appreciated by those skilled in the art that many kinds, types, or forms of closure elements may be used without departing from the scope or spirit of the present invention.

Figure 6:
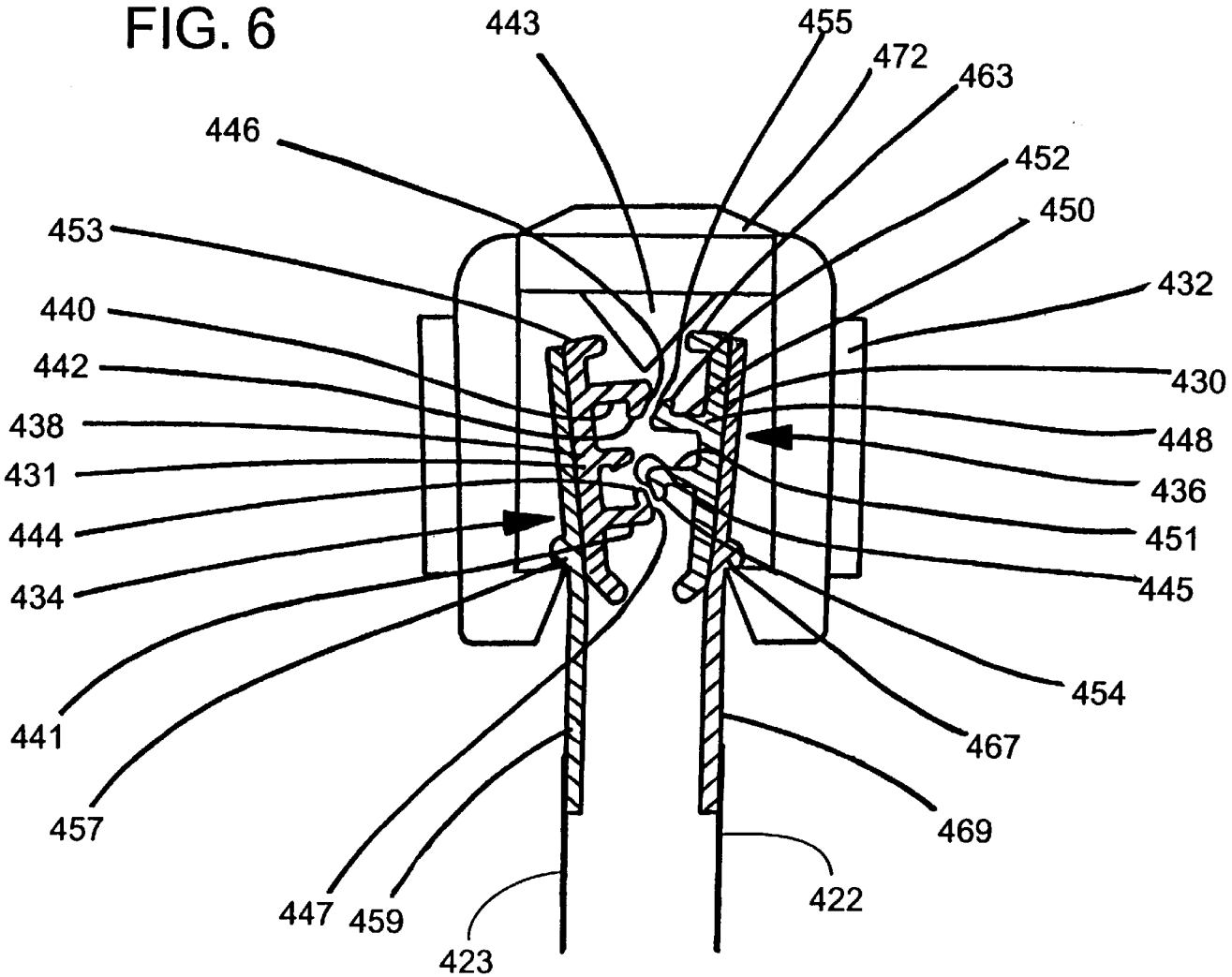
FIG. 6 is a cross-sectional view of one embodiment of the closure elements.

As shown in FIG. 6, the fastening strips may be U-channel fastening strips as described in U.S. Pat. No. 4,829,641. U-channel fastening strips include a first fastening strip 430 with a first closure element 436 and a second fastening strip 431 with a second closure element 434. The first closure element 436 engages the second closure element 434. The first fastening strip 430 may include a flange 463 disposed at the upper end of the first fastening strip 430 and a rib 467 disposed at the lower end of the first fastening strip 430. The first fastening strip 430 may also include a flange portion 469. Likewise, the second fastening strip 431 may include a flange 453 disposed at the upper end of the second fastening strip 431 and a rib 457 disposed at the lower end of the second fastening strip 431. The second fastening strip 431 may also include a flange portion 459. The side walls 422, 423 of the plastic bag may be attached as noted above.

The second closure element 434 includes a base portion 438 having a pair of spaced-apart parallely disposed webs 440, 441, extending from the base portion 438. The base and the webs form a U-channel closure element. The webs 440, include hook closure portions 442, 444 extending from the webs 440, 441 respectively, and facing towards each other. The hook closure portions 442, 444 include guide surfaces 446, 447 which serve to guide the hook closure portions 442, 444 for occluding with the hook closure portions 452, 454 of the first closure element 436.

The first closure element 436 includes a base portion 448 including a pair of spaced-apart, parallely disposed webs 450, 451 extending from the base portion 448. The base and the webs form a U-channel closure element. The webs 450, 451 include hook closure portions 452, 454 extending from the webs 450, 451 respectively and facing away from each other. The hook closure portions 452, 454 include guide surfaces 445, 455, which generally serve to guide the hook closure portions 452, 454 for occlusion with the hook closure portions 442, 444 of the second closure element 434. The guide surfaces 445, 455 may also have a rounded crown surface.

The slider 432 includes a top portion 472. The top portion provides a separator 443 having a first end and a second end wherein the first end may be wider than the second end. In addition, the separator 443 may be triangular in shape. When the slider is moved in the occlusion direction, the separator 443 deoccludes the fastening strips 430, 431 as shown in FIG. 6. Referring to FIG. 6, the closure elements 434, 436 are deoccluded and specifically, the upper hook portions 442, 452 and the lower hook portions 444, 454 are deoccluded.

The first closure element 436 may be made of a first material and the flange portion 469 may be made of a second material. The second closure element 434 may be made of the first material or the second closure element 434 may be made of a third material. The flange portion 459 may be made of the second material or the flange portion 459 may be made of a fourth material. The density of the materials would be chosen as noted above in accordance with the invention.

Figure 7:
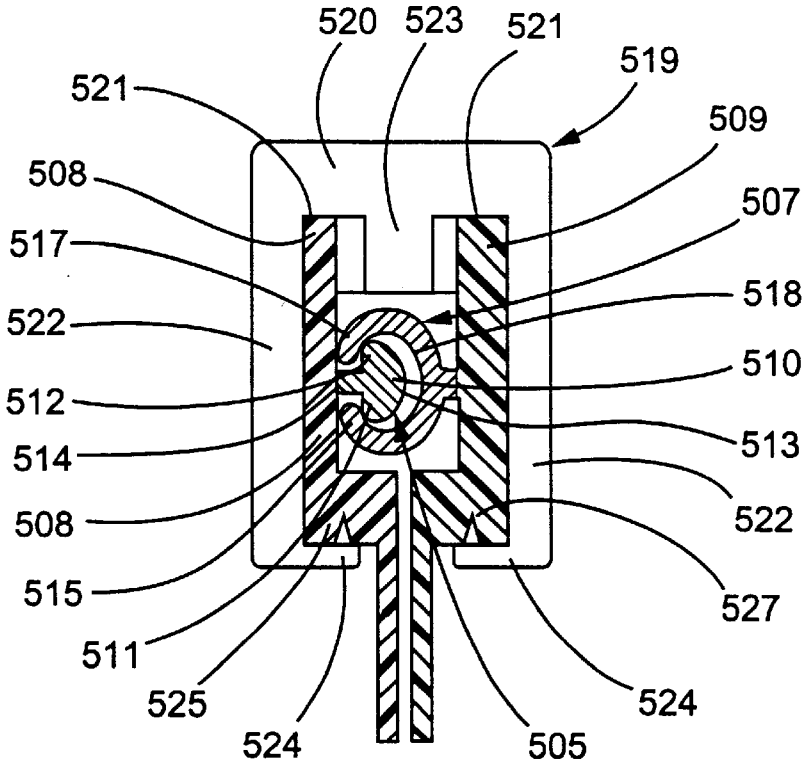
FIG. 7. is a cross-sectional view of one embodiment of the closure elements.

The interlocking fastening strips may comprise "arrowhead-type" or "rib and groove" fastening strips as shown in FIG. 7 and as described in U.S. Pat. No. 3,806,998. The rib element 505 interlocks with the groove element 507. The rib element 505 is of generally arrow-shape in transverse cross section including a head 510 comprising interlock shoulder hook portions 511 and 512 generally convergently related to provide a cam ridge 513 generally aligned with a stem flange 514 by which the head is connected in spaced relation with respect to the supporting flange portion 508. (U.S. Pat. No. 3,806,998, Col. 2, lines 16–23). At their surfaces nearest the connecting stem flange 514, the shoulder portions 511 and 512 define reentrant angles therewith providing interlock hooks engageable with interlock hook flanges 515 and 517 respectively of the groove element 507. (U.S. Pat. No. 3,806,998, Col. 2, lines 23–28). Said hook flanges generally converge toward one another and are spread open to receive the head 510 therebetween when said head is pressed into said groove element 507 until the head is fully received in a groove 518 of said groove element 507 generally complementary to the head and within which the head is interlocked by interengagement of the head shoulder hook portions 511 and 512 and the groove hook flanges 515 and 517. (U.S. Pat. No. 3,806,998, Col. 2, lines 28–36). Through this arrangement, as indicated, the head and groove elements 505 and 507 are adapted to be interlockingly engaged by being pressed together and to be separated when forcably pulled apart, as by means of a generally U-shaped slider 519. (U.S. Pat. No. 3,806,998, Col. 2, lines 36–41).

The slider 519 includes a flat back plate 520 adapted to run along free edges 521 on the upper ends of the sections of the flange portions 508 and 509 as shown in the drawing. (U.S. Pat. No. 3,806,998, Col. 2, lines 41–46). Integrally formed with the back plate 520 and extending in the same direction (downwardly as shown) therefrom are respective coextensive side walls 522 with an intermediate spreader finger 523 extending in the same direction as the side walls at one end of the slider. (U.S. Pat. No. 3,806,998, Col. 2, lines 46–51). The side walls 522 are in the form of panels which are laterally divergent from a narrower end of the slider. (U.S. Pat. No. 3,806,998, Col. 2, lines 51–55). The slider walls 522 are each provided with an inwardly projecting shoulder structure 524 flange adapted to engage respective shoulder ribs 525 and 527 on respectively outer sides of the lower section of the flange portions 508 and 509. (U.S. Pat. No. 3,806,998, Col. 2, line 66 to Co. 3, line 3).

The head 510 and the stem flange 514 may be made of a first material and the flange portion 508 may be made of a second material. In addition, the groove element 507 may be made of the first material or the groove element may be made of a third material. The flange portion 509 may be made of the second material or the flange portion 509 may be made of a fourth material. The density of the materials would be chosen as noted above in accordance with the invention.

Figure 8:
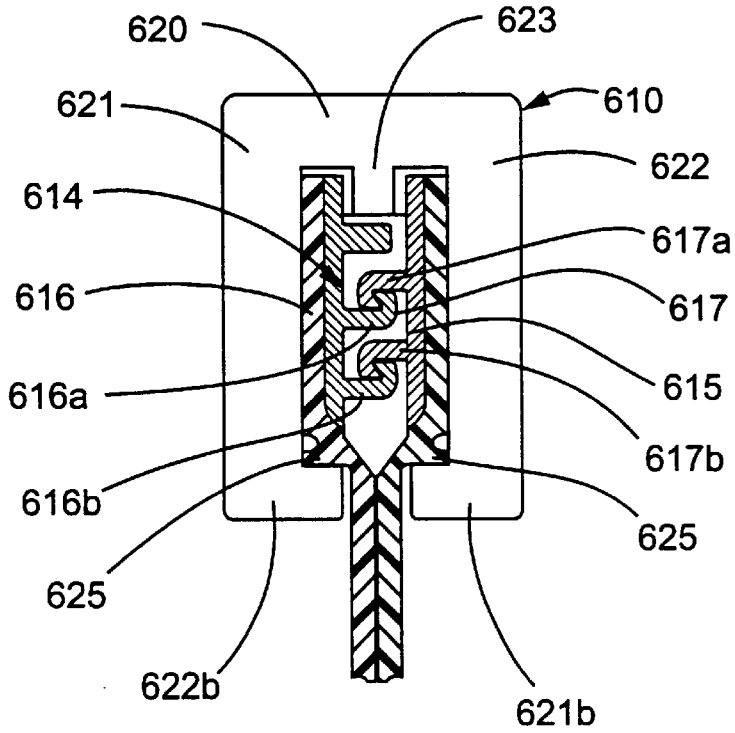
FIG. 8 is a cross-sectional view of one embodiment of the closure elements.

Additionally, the interlocking fastening strips may comprise "profile" fastening strips, as shown in FIG. 8 and described in U.S. Pat. No. 5,664,299. As shown in FIG. 8, the first profile 616 has at least an uppermost closure element 616*a* and a bottommost closure element 616*b*. (U.S. Pat. No. 5,664,299, Col. 3, lines 25–27). The closure elements 616*a* and 616*b* project laterally from the inner surface of strip 614. (U.S. Pat. No. 5,664,299, Col. 3, lines 27–28). Likewise, the second profile 617 has at least an uppermost closure element 617*a* and a bottommost closure element 617*b*. (U.S. Pat. No. 5,664,299, Col. 3, lines 28–30). The closure elements 617*a* and 617*b* project laterally from the inner surface of strip 615. (U.S. Pat. No. 5,664,299, Col. 3, lines 30–32). When the bag is closed, the closure elements of profile 616 interlock with the corresponding closure elements of profile 617. (U.S. Pat. No. 5,664,299, Col. 3, lines 32–34). As shown in FIG. 8, closure elements 616*a*, 616*b*, 617*a* and 617*b* have hooks on the ends of the closure elements, so that the profiles remain interlocked when the bag is closed, thereby forming a seal. (U.S. Pat. No. 5,664,299, Col. 3, lines 34–37).

The straddling slider 610 comprises an inverted U-shaped member having a top 620 for moving along the top edges of the strips 614 and 615. (U.S. Pat. No. 5,664,299, Col. 4, lines 1–3). The slider 610 has side walls 621 and 622 depending from the top 620. (U.S. Pat. No. 5,664,299, Col. 4, lines 3–4). A separating leg 623 depends from the top 620 between the side walls 621 and 622 and is located between the uppermost closure elements 616*a* and 617*a* of profiles 616 and 617. (U.S. Pat. No. 5,664,299, Col. 4, lines 26–30). The fastening assembly includes ridges 625 on the outer surfaces of the fastening strips 614 and 615, and shoulders 621*b* and 622*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 625. (U.S. Pat. No. 5,664,299, Col. 5, lines 4–7).

The first profile 616 may include a profile portion 630 and a flange portion 632. The profile portion 630 may be made of a first material and the flange portion 632 may be made of a second material. The second profile 617 may include a profile portion 640 and a flange portion 642. The profile portion 640 may be made of the first material or the profile portion 640 may be made of a third material. The flange portion 642 may be made of the second material or the flange portion 642 may be made of a fourth material. The density of the materials would be chosen as noted above in accordance with the invention.

The interlocking fastening strips may be manufactured by extrusion through a die. The interlocking fastening strips may be formed from any suitable thermoplastic material including, for example, polyethylene, polypropylene, nylon, or the like, or from a combination thereof. Thus, resins or mixtures of resins such as high-density polyethylene, medium density polyethylene, low-density polyethylene, linear low density polyethylene, tubular low density polyethylene, ethylene vinylacetate copolymer, polypropylene or nylon may be employed to prepare the closure elements and flange portions.

The closure element may have a density in the range of 0.910 g/cc to 0.960 g/cc, preferably in the range of 0.918 g/cc to 0.940 g/cc, and more preferably in the range of 0.921 g/cc to 0.925 g/cc. The flange portion may have a density in the range of 0.914 g/cc to 0.964 g/cc, preferably in the range of 0.922 g/cc to 0.944 g/cc, and more preferably in the range of 0.925 g/cc to 0.932 g/cc.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. The closure device may be manufactured as individual fastening strips for later attachment to the bag.

The fastening strips can be manufactured in a variety of forms to suit the intended use. The fastening strips may be connected to the container by the use of any of many known methods. For example, a thermoelectric device may be applied to a film in contact with the flange portion of the fastening strips to cause a transfer of heat through the film to produce melting at the interface of the film and a flange portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips would usually be positioned on the film in a generally parallel relationship with respect to each other, although this will depend on the intended use.

The closure device may also include a slider for facilitating the occlusion and deocclusion of the fastening strips. The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and copending applications cited herein are hereby incorporated by reference in their entireties.

What is claimed is:

1. A closure device, comprising:

a first fastening strip, the first fastening strip includes a closure element attached to a flange portion, the closure element is made of a material with a first density, the flange portion is made of a material with a second density, the first density is lower than the second density.

2. The invention as in claim 1 wherein the closure element is a profile closure element.

3. The invention as in claim 1 wherein the closure element is a rolling action closure element.

4. The invention as in claim 1 wherein the closure device includes a second fastening strip, the second fastening strip includes a second closure element attached to a second flange portion, the second closure element is made of a material with a third density, the second flange portion is made of a material with a fourth density, the third density is different tan the fourth density.

5. The invention as in claim 4 wherein the third density of the second closure element is lower than the fourth density of the second flange portion.

6. The invention as in claim 5 wherein the first density is equal to the third density and the second density is equal to the fourth density.

7. The invention as in claim 4 wherein the third density of the second closure element is higher than the fourth density of the second flange portion.

8. The invention as in claim 4 wherein the closure device includes a slider slidably disposed on the fastening strips for movement between first and second ends thereof, the slider facilitating occlusion of the fastening strips when moved towards the first end, the slider including a separator facilitating the deocclusion of the fastening strips when the slider is moved towards the second end.

9. The invention as in claim 1 wherein the difference between the first density and the second density reduces curvature of the fastening strip.

10. The invention as in claim 1 wherein the first density is in the range of 0.910 g/cc–0.960 g/cc.

11. The invention as in claim 10 wherein the second density is in the range of 0.914 g/cc–0.964 g/cc.

12. The invention as in claim 1 wherein the second density is in the range of 0.914 g/cc–0.964 g/cc.

13. The invention as in claim 1 wherein the material for the closure element is from the group consisting of; low density polyethylene, medium density polyethylene, high density polyethylene, linear low density polyethylene, tubular low density polyethylene, ethylene vinylacetate copolymer, polypropylene or nylon.

14. The invention as in claim 1 wherein the material for the flange portion is from the group consisting of: low density polyethylene, medium density polyethylene, high density polyethylene, linear low density polyethylene, tubular low density polyethylene, ethylene vinylacetate copolymer, polypropylene or nylon.

15. The invention as in claim 1 wherein the closure element is an arrowhead closure element.

16. The invention as in claim 1 wherein the closure element is a U-channel closure element.

17. A container comprising:

first and second sidewalls joined to form a compartment with an opening;

a first fastening strip, the first fastening strip includes a closure element attached to a flange portion, the closure element is made of a material with a first density, the flange portion is made of a material with a second density, the first density is lower than the second density.

18. The invention as in claim 17 wherein the closure element is a U-channel closure element.

19. The invention as in claim 17 wherein the closure element is an arrowhead closure element.

20. The invention as in claim 17 wherein the closure element is a profile closure element.

21. The invention as in claim 17 wherein the flange portion is attached to the first sidewall.

22. The invention as in claim 17 wherein the flange portion is a portion of the sidewall.

23. The invention as in claim 17 wherein the closure element is a rolling action closure element.

24. The invention as in claim 17 further comprising:

a second fastening strip, the second fastening strip including a second closure element attached to a second flange portion, the second closure element being made of a material with a third density, the second flange portion being made of a material with a fourth density, the third density being different than the fourth density.

25. The invention as in claim 24 wherein the third density of the second closure element is lower than the fourth density of the second flange portion.

26. The invention as in claim 24 wherein the third density of the second closure element is higher than the fourth density of the second flange portion.

27. The invention as in claim 25 wherein the first density is equal to the third density and the second density is equal to the fourth density.

28. The invention as in claim 24 further comprising:

a slider slidably disposed on the fastening strips for movement between first and second ends thereof, the slider facilitating occlusion of the fastening strips when moved towards the first end, the slider including a separator facilitating the deocclusion of the fastening strips when the slider is moved towards the second end.

29. The invention as in claim 17 wherein the first density is in the range of 0.910 g/cc–0.960 g/cc.

30. The invention as in claim 29 wherein the second density is in the range of 0.914 g/cc–0.964 g/cc.

31. The invention as in claim 17 wherein the difference between the first density and the second density reduces curvature of the fastening strip.

32. The invention as in claim 17 wherein the material for the closure element is from the group consisting of: low density polyethylene, medium density polyethylene, high density polyethylene, linear low density polyethylene, tubular low density polyethylene, ethylene vinylacetate copolymer, polypropylene or nylon.

33. The invention as in claim 17 wherein the material for the flange portion is from the group consisting of: low density polyethylene medium density polyethylene, high density polyethylene, linear low density polyethylene, tubular low density polyethylene, ethylene vinylacetate copolymer, polypropylene or nylon.

34. The invention as in claim 17 wherein the second density is in the range of 0.914 g/cc–0.964 g/cc.

35. A method of manufacturing a closure device, comprising:

providing a first fastening strip, the first fastening strip includes a closure element attached to a flange portion, providing that the closure element is made of a material with a first density; and providing that the flange portion is made of a material with a second density, the first density is lower than the second density.

36. The invention as in claim 35 wherein the closure element is an arrowhead closure element.

37. The invention as in claim 35 wherein the closure element is a profile closure element.

38. The invention as in claim 35 wherein the closure element is a rolling action closure element.

39. The invention as in claim 35 further comprising:

providing a second fastening strip, the second fastening strip including a second closure element attached to a second flange portion, the second closure element being made of a material with a third density, the second flange portion being made of a material with a fourth density, the third density being different than the fourth density.

40. The invention as in claim 39 wherein the third density of the second closure element is lower than the fourth density of the second flange portion.

41. The invention as in claim 40 wherein the first density is equal to the third density and the second density is equal to the fourth density.

42. The invention as in claim 39 wherein the third density of the second closure element is higher than the fourth density of the second flange portion.

43. The invention as in claim 35 wherein the difference between the first density and the second density reduces curvature of the fastening strip.

44. The invention as in claim 35 wherein the first density is in the range of 0.910 g/cc–0.960 g/cc.

45. The invention as in claim 44 wherein the second density is in the range of 0.914 g/cc–0.964 g/cc.

46. The invention as in claim 35 wherein the second density is in the range of 0.914 g/cc–0.964 g/cc.

47. The invention as in claim 35 wherein the material for the closure element is from the group consisting of: low density polyethylene, medium density polyethylene, high density polyethylene, linear low density polyethylene, tubular low density polyethylene, ethylene vinylacetate copolymer, polypropylene or nylon.

48. The invention as in claim 35 wherein the material for the flange portion is from the group consisting of: low density polyethylene, medium density polyethylene, high density polyethylene, linear low density polyethylene, tubular low density polyethylene, ethylene vinylacetate copolymer, polypropylene or nylon.

49. The invention as in claim 39 further comprising:

providing a slider slidably disposed on the fastening strips for movement between first and second ends thereof, the slider facilitating occlusion of the fastening strips when moved towards the first end, the slider including a separator facilitating the deocclusion of the fastening strips when the slider is moved towards the second end.

50. The invention as in claim 35 wherein the closure element is a U-channel closure clement.

* * * * *